United States Patent [19]

Pabst et al.

[11] Patent Number: 4,906,895

[45] Date of Patent: Mar. 6, 1990

[54] HIGH-PRESSURE DISCHARGE LAMP WITH STABILIZED ARC

[75] Inventors: Wolfgang Pabst; Manfred Rehmet, both of Munich, Fed. Rep. of Germany

[73] Assignee: PATENT TREUHAND GESELLSCHAFT für elektrische Gluhlampen m.b.H., Munich, Fed. Rep. of Germany

[21] Appl. No.: 215,829

[22] Filed: Jul. 6, 1988

[30] Foreign Application Priority Data

Jul. 14, 1987 [DE] Fed. Rep. of Germany ..... 3723271

[51] Int. Cl.[4] ..... H01J 61/073

[52] U.S. Cl. ..... 313/632; 313/633; 313/311; 313/336

[58] Field of Search ..... 313/574, 575, 630, 631, 313/632, 310, 311, 336, 345, 346 R, 355, 633

[56] References Cited

U.S. PATENT DOCUMENTS 3,054,014 9/1962 Gemsa ..... 313/352

FOREIGN PATENT DOCUMENTS 0087826 9/1983 European Pat. Off. .
55-72352 5/1980 Japan .
57-9044 1/1982 Japan .
60-131751 7/1985 Japan .
929668 6/1963 United Kingdom .

OTHER PUBLICATIONS

"Materials for Scientific Research", vol. 10 (12/1975), pp. 295 et seq., Gessinger et al.

*Primary Examiner*—Kenneth Wieder
*Attorney, Agent, or Firm*—Frishauf, Holtz, Goodman & Woodward

[57] ABSTRACT

To improve the arc stability of a high-pressure arc discharge lamp, typically a xenon arc lamp, the cathode (4) has an essentially conical end portion (9), terminating in a roughly flat, or slightly rounded tip (10). The cathode is covered with a carbide layer (11) decreasing in thickness towards the tip (10) and, preferably, leaving a zone (12) adjacent the tip and extending over about one-third of the end zone (9) free from carbide. The carbide has a lower melting temperature than the tungsten of the electrode, and leaving the tip free from carbide prevents deterioration of the electrode due to melting of the carbide material, in operation of the lamp.

20 Claims, 1 Drawing Sheet

HIGH-PRESSURE DISCHARGE LAMP WITH STABILIZED ARC

Reference to related patent, assigned to the assignee of the present application, the disclosure of which is hereby incorporated by reference: U.S. Pat. No. 3,054,014, Gemsa. Reference to related publications: European Patent 0 087 826, Gartner. British Patent 929,668. Article in "Materials for Scientific Research", Vol. 10 (1975), page 295 et seq., by Gessinger and Buxbaum.

The present invention relates to high-pressure discharge lamps, and more particularly to high-pressure discharge lamps adapted for direct current operation, in which two electrodes are retained within a transparent discharge vessel, and an arc is struck between the electrodes.

BACKGROUND

U.S. Pat. No. 3,054,014, Gemsa, assigned to the assignee of the present application and the disclosure of which is hereby incorporated by reference, describes an electrode for high-pressure discharge vessels with gas or vapor filling, in which the electrode is made of a thorium dioxide containing tungsten rod. Lamps of this type are usually used with apparatus requiring a point-like radiation source, for example for use in an optical or scientific system. Problems arise in connection with electrodes of this type due to instability of the arc between the electrodes. Due to such instability, intensity of radiation will vary. Further, the tip of the electrode which functions as a cathode may deteriorate. None of these problems arise in electrodes used in electrode tubes.

Requirements for arc stability, uniformity of light output and lifetime have increased recently. The use of such lamps has, additionally, increased; new fields of application have opened up with improvements in such lamps.

To understand the improvement by the present invention, a review of prior art is in order. Specific reference is made to British Patent 929,668, Jones, and European Patent 0 087 826, Gartner. Both of these disclosures generally are directed to electrodes for electron tubes. These electron tube electrodes use a material which is highly temperature resistant, that is, has a high melting point. The typical material is tungsten. The tungsten is doped with an electron emissive material, usually thorium oxide ($ThO_2$). The proportion of thorium oxide may vary within a wide range, depending on the purpose of the electrode, for example between 0.1 to 5%, by weight. Due to the high operating temperature of the lamp, elementary emitter material is formed which, preferably by diffusion along the grain boundaries, travels to the surface. This process is determinative for the quality of the electrode and can be influenced in various ways. Additionally, doping, for example with potassium or aluminum, can change the grain structure so that the grain boundary diffusion is additionally facilitated.

It is also known to dope a metallic body with carbon, in order to facilitate reduction of the emitter material. For example, carbon reduces $ThO_2$ to Th, and $CO_2$ is generated. For this purpose an external carbide layer can be applied to the metallic body. The high diffusion rate of carbon ensures penetration into the metallic body, see for example the cited literature by Gessinger and Buxbaum, "Materials for Scientific Research", Vol. 10 (1975), page 295 et seq.

THE INVENTION

It is an object to improve a short-arc high-pressure discharge lamp by reducing variations in intensity of the arc, to quiet the arc, and to prevent premature destruction of the cathode tip.

Briefly, a carbide layer is applied to the cathode which, otherwise, can be of conventional construction, which carbide layer has the characteristics that the thickness thereof decreases towards the tip; in accordance with a preferred feature of the invention, the thickness of the carbide layer decreases uniformly towards the tip, leaving the tip itself free and uncoated.

In accordance with a particularly preferred embodiment of the invention, the region of the tip of the cathode is free of carbide. Such cathodes are used in short arc lamps, for example xenon high-pressure and mercury high-pressure lamps, in which temperatures may occur in the region of the cathode tip which exceed the melting temperature of tungsten carbide. This melting temperature is at about 2710° C. If tungsten carbide would be present and this melting temperature is exceeded, the tip would melt to some extent; as a result, diffusion of thorium into the tip would be interfered with resulting in an increase in the work function at the tip region, rendering electron emission more difficult and, then, additionally resulting in instability of the arc.

The specifically placement of the carbide in accordance with the present invention has the advantage that the stability of the arc is substantially improved, and the lifetime of the lamp and particularly the cathode, is improved without the danger of melt-back due to tungsten carbide at the very tip itself.

Drawing, showing illustrative embodiments:

DETAILED DESCRIPTION

Figure 1:
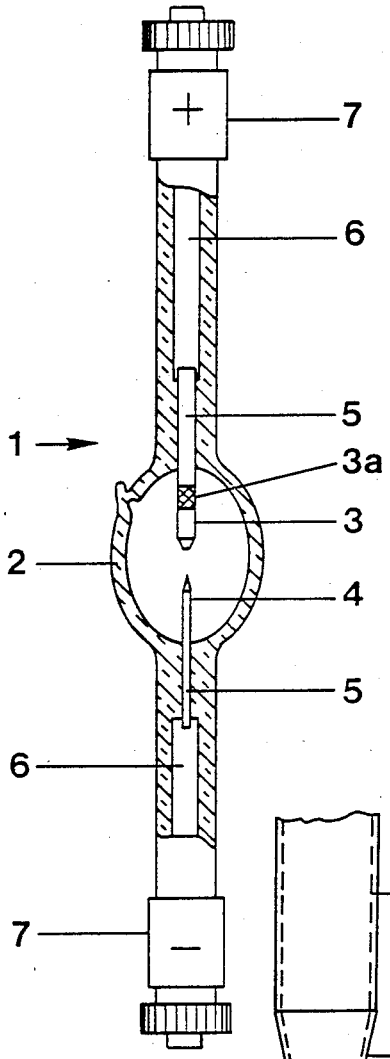
FIG. 1 is a highly schematic vertical cross-sectional view through a short-arc high-pressure xenon discharge lamp.

The lamp 1 of FIG. 1 is a low-power xenon short arc lamp having, for example, a power rating of 150 W. It can be used as a light source in projectors, in spectral photometers, and in color reproduction apparatus.

The lamp 1 has a generally ellipsoid discharge vessel 2 of quartz glass and is filled with xenon, in a quantity so that the operating pressure will be about 50 bar. An anode 3 and a cathode 4 are secured within the discharge vessel, spaced from each other by a distance of about 2 mm, in axial alignment. Each electrode has an electrode shaft 5 which is welded or otherwise connected to a respective molybdenum foil 6 which, in turn, is coupled to terminals 7 at the bases of the lamp 1 by metallic pins (not shown). The molybdenum foils 6 are vacuum tightly melted into the ends of the discharge vessel 2. Other connection arrangements and different technologies of connections may be used, for example melting-in of electrode rods, cup-connections, or the like.

The anode 3 is made of a massive cylindrical block of hammered tungsten and has a getter material 3*a*, for example zirconium, attached thereto, as schematically illustrated by the crisscross hatched area. At the tip end, the anode 3 is slightly conically formed, with a flat end surface, to form a wide, externally slightly inclined discharge surface.

Figure 2:
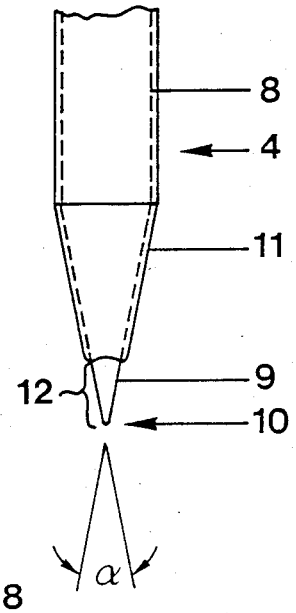
FIG. 2 is a fragmentary highly enlarged view, not to scale, of an especially preferred form of a cathode.

The cathode 4 is substantially smaller than the anode 3. It is made of tungsten, which is doped with thorium dioxide ($ThO_2$) present in about 0.4% (by weight). FIG. 2 illustrates this cathode to an enlarged scale without, however, being exactly to scale as such. High stability of the arc can be obtained by forming the cathode in pointed shape. To this end, the cylindrical base body 8 of the cathode 4 is pointed to form a cone 9, with a rounded or cut-off or truncated tip 10. The cone is formed with an opening angle $\alpha$ of about 25°; the angle $\alpha$ is shown in mirror image below the cone 9.

The body 8, typically, has a diameter of about 2 mm, and the overall length of the cone 9 is about 4 mm.

In accordance with the invention, cone 9 is surrounded by a layer 11 of tungsten carbide for about two-thirds of its length. The thickness of the tungsten carbide layer adjacent the base end of the cone 9 is about 10 micrometers. The remaining third of the length of the cone, a zone 12 of about 1.3 mm length, is left free from carbide.

The length of the carbide free zone of the cone, in this embodiment, is at least 0.7 mm. The minimum length can be readily experimentally determined and is governed, essentially, by the temperature distribution at the tip of the cathode. The zone 12 free from tungsten carbide coating material 11 ensures that the tip 10 will not melt due to the presence of tungsten carbide which has a lower melting temperature than tungsten as such.

In order to obtain the carbide layer, a charge of cathodes placed in a carrier is processed in a carbonizing apparatus. Carbon is dissociated from a carbon-containing gas, for example $CH_4$ using, for example, the CVD process. The thickness of the layer of 10 micrometers can be obtained by maintaining a gas flow of about 1 liter per minute for about 10 minutes at 2100° C. The zone 12 at the tip of each cone 9, and free from carbon, can be obtained by placing these zones in depressions within the charge carrier of the carbonizing apparatus. This method will result in a portion of the carbide layer 11 extending over the cylindrical body 8; this extension of the carbide layer is irrelevant, however, for the present invention.

In a test of about 1000 hours, it was determined that lamps which have cathodes in accordance with the present invention have variations in brightness of less than 4%; the intensity drift in continuous operation is less than 1% per hour. No premature failures due to melting at the tip 10 were observed.

Figure 3:
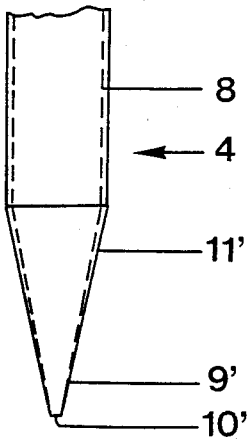

In accordance with another embodiment of the invention, the entire cone 9' (FIG. 3) is covered with a carbide layer 11', the thickness of which, however, decreases continuously from the base of the cone 9' towards the tip 10'. Decrease of the carbide layer can be obtained by applying the carbon by brushing-on, spraying, or the like; by suitable processing, for example permitting some of the applied substance to run off, by etching, or the like, the carbide layer can be reduced in thickness or thinned, towards the tip 10'. The tip 10' terminates in a truncated surface, obtained by grinding off the end of cone 9' in order to ensure that the truncated surface is free from carbide.

Figure 4:
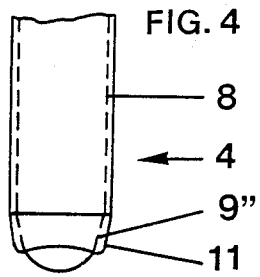
FIGS. 3 and 4 are fragmentary views, similar to FIG. 2, showing another embodiment.

Various changes and modifications may be made within the scope of the inventive concept. For example, the shape of the cathode may be different from that shown in FIG. 2. For example, the cylindrical base body may be provided with a shaft portion of reduced diameter and, as a further modification, rather than using a conical end portion for the rod cathode 8, a semi-spherical end 9'' (FIG. 4), leaving the free zone 12, can be used. The length of the carbide free zone in the first embodiment is preferably longer than the minimum length discussed above to take care of tolerances that may occur during preparation of the layer. Otherwise, this length should not exceed the length of the carbide layer to avoid deterioration of and ensure reliability of the thorium supply to the tip.

We claim:

1. High-pressure arc discharge lamp (1) having
a transparent vessel (2);
two facing electrodes (3, 4), a first electrode (3) and a second electrode (4) forming a cathode,
and wherein the cathode (4) comprises an essentially cylindrical body (8) of high-temperature resistant material doped with an electron-emitting material, said electrode having an end portion (9) of reduced diameter and terminating in a tip (10, 10'),
a cover layer of a carbide of the metal of the electrode coating the outside of the cylindrical body at least in the region of the end portion (9) of reduced diameter (9),
and wherein, in accordance with the invention,
the thickness dimension of the carbide cover layer (11) is small with respect to the diameter of the cylindrical body (8) of the cathode (4) and decreases towards the tip (10) of the electrode.

2. The lamp of claim 1, wherein the region in the tip of the electrode is free from carbide.

3. The lamp of claim 1, wherein the end portion (9) of reduced diameter terminating in the tip defines an end length;
and wherein a part (12) of the end portion adjacent the tip (10) is free from said carbide cover layer (11), said part extending for about one-third of said end length.

4. The lamp of claim 1, wherein the thickness of the carbide cover layer (11') decreases essentially uniformly towards the tip (10').

5. The lamp of claim 1, wherein said end zone (9) is conical.

6. The lamp of claim 1, wherein said end zone (9'') is at least part-spherical.

7. The lamp of claim 1, wherein said end zone (9') is essentially conical, and terminates in a truncated surface to form an essentially flat surface (10'):

8. The lamp of claim 5, wherein the region in the tip of the electrode is free from carbide.

9. The lamp of claim 6, wherein the region in the tip of the electrode is free from carbide.

10. The lamp of claim 7, wherein the region in the tip of the electrode is free from carbide.

11. The lamp of claim 1, wherein the material of the cathode comprises tungsten, and the electron-emitting doping material comprises thorium dioxide.

12. The lamp of claim 1, wherein the cathode comprises additional doping material.

13. The lamp of claim 1, wherein the thickness of the carbide cover layer (11) is about 10 micrometers.

14. The lamp of claim 1, wherein the diameter of the cylindrical body (8) of the cathode (4) is about 2 mm.

15. The lamp of claim 2, wherein the thickness of the carbide cover layer (11) is about 10 micrometers.

16. The lamp of claim 2, wherein the diameter of the cylindrical body (8) of the cathode (4) is about 2 mm.

17. The lamp of claim 15, wherein the diameter of the cylindrical body (8) of the cathode (4) is about 2 mm.

18. The lamp of claim 3, wherein the thickness of the carbide cover layer (11) is about 10 micrometers.

19. The lamp of claim 3, wherein the diameter of the cylindrical body (8) of the cathode (4) is about 2 mm.

20. The lamp of claim 18, wherein the diameter of the cylindrical body (8) of the cathode (4) is about 2 mm.

* * * * *